US008839545B1

(12) United States Patent
Gangl et al.

(10) Patent No.: US 8,839,545 B1
(45) Date of Patent: Sep. 23, 2014

(54) RIFLE GUARD RAPID CONFIGURATION SYSTEM

(71) Applicants: John Paul Gangl, Hugo, MN (US); David Adolfson, Hugo, MN (US)

(72) Inventors: John Paul Gangl, Hugo, MN (US); David Adolfson, Hugo, MN (US)

(73) Assignee: J & K IP Assets, LLC, Cheyenne, WY (US)

( * ) Notice: Subject to any disclaimer, the term of this patent is extended or adjusted under 35 U.S.C. 154(b) by 0 days.

(21) Appl. No.: 13/962,844

(22) Filed: Aug. 8, 2013

Related U.S. Application Data

(60) Provisional application No. 61/680,940, filed on Aug. 8, 2012.

(51) Int. Cl.
*F41C 23/16* (2006.01)

(52) U.S. Cl.
CPC ..... *F41C 23/16* (2013.01)
USPC ..... 42/75.03

(58) Field of Classification Search
CPC ..... F41A 21/482
USPC ..... 42/75.03, 75.02, 75.01, 77, 72, 75.1
See application file for complete search history.

(56) References Cited

U.S. PATENT DOCUMENTS

| | | | | |
|---|---|---|---|---|
| 1,738,500 | A * | 12/1929 | Moore | 42/75.02 |
| 5,412,895 | A * | 5/1995 | Krieger | 42/75.02 |
| 6,694,660 | B1 * | 2/2004 | Davies | 42/75.01 |
| 7,716,865 | B2 * | 5/2010 | Daniel et al. | 42/75.02 |
| 8,069,604 | B2 * | 12/2011 | Larue | 42/75.1 |
| 8,276,303 | B2 * | 10/2012 | Kapusta et al. | 42/71.01 |
| 8,479,429 | B2 * | 7/2013 | Barrett et al. | 42/75.02 |
| 8,539,708 | B2 * | 9/2013 | Kenney et al. | 42/75.02 |
| 2004/0049964 | A1 | 3/2004 | Vais | |
| 2007/0017139 | A1 * | 1/2007 | Larue | 42/75.1 |
| 2012/0005936 | A1 | 1/2012 | Daniel | |
| 2012/0036756 | A1 | 2/2012 | Brown | |
| 2013/0180151 | A1 * | 7/2013 | Moore | 42/90 |

FOREIGN PATENT DOCUMENTS

GB 2157406 A * 10/1985

* cited by examiner

*Primary Examiner* — Reginald Tillman, Jr.

(74) *Attorney, Agent, or Firm* — Dwayne E. Rogge; Schacht Law Office, Inc.

(57) ABSTRACT

Disclosed is a hand guard attachment system. The system in one form comprising a barrel nut affixed to an upper receiver of the firearm and a jam nut each with a threaded outer surface aligned with and co-axial to a bore of the firearm. The rapid configuration system may include a plurality of indexing pins aligned with, but not coaxial to the bore of the firearm. The hand guard may include an inner threaded surface where the threads cooperate with the threads of the jam nut and barrel nut. A method for attachment of the hand guard to the firearm is also disclosed. The method in one form including the steps of: threading the hand guard onto the jam nut and barrel nut; and tensioning the set screws. The method may include a step where the set screws are adjusted to manipulate the angle of the hand guard relative to the bore.

8 Claims, 10 Drawing Sheets

RIFLE GUARD RAPID CONFIGURATION SYSTEM

RELATED APPLICATIONS

This application claims priority benefit of U.S. Ser. No. 61/680,940, filed Aug. 8, 2012, incorporated herein by reference.

BACKGROUND OF THE DISCLOSURE

Field of the Disclosure

This application relates to the field of hand guard attachment systems for live fire firearms.

SUMMARY OF THE DISCLOSURE

Disclosed herein is a firearm hand guard rapid configuration system with examples of the interoperating components. The system in one form comprising: a barrel nut affixed to an upper receiver of the firearm. The barrel nut in one form comprising: a threaded outer cylindrical surface aligned with and co-axial to a bore of the firearm; a surface defining an inner cylindrical face aligned with and co-axial to a bore of the firearm; a plurality of surfaces defining indexing voids aligned with, but not coaxial to, the bore of the firearm; and wherein the indexing voids are formed (machined, cast or drilled) radially between the threaded outer surface and the inner cylindrical face of the barrel nut.

Also disclosed is a jam nut, comprising in one form a threaded outer cylindrical surface aligned with and co-axial to a bore of the firearm. This surface having a thread diameter and thread pitch as the outer cylindrical surface of the barrel nut. The jam nut also has a surface defining an inner cylindrical face aligned with and co-axial to a bore of the firearm. Generally, the jam nut is arranged wherein the indexing pins have an outer diameter slightly smaller than the indexing voids of the barrel nut so as to index therein such that the jam nut is longitudinally positionable relative to the barrel nut. The jam nut may also utilize a plurality of threaded set screw receivers aligned with but not coaxial to the bore of the firearm.

The rapid configuration system as recited above may be arranged wherein the plurality of set screws includes three or more set screws.

The rapid configuration system as recited above may further comprise a plurality of indexing pins aligned with, but not coaxial to the bore of the firearm.

The rapid configuration system may be arranged wherein the jam nut further comprises a surface defining a gas vent aligned with but not coaxial to the bore of the firearm.

The rapid configuration system, as recited above, may further comprise a vented hand guard having at one longitudinal end an inner cylindrical surface aligned with and co-axial to a bore of the firearm. This inner cylindrical surface having a thread diameter and thread pitch equivalent to the outer cylindrical surface of the barrel nut and jam nut.

A method for attachment of a hand guard to a firearm is also disclosed. The method comprising the steps of: providing a rapid configuration system as recited herein; threading the hand guard onto the jam nut and barrel nut; and tensioning the set screws thus imparting tensional forces between the threads of the hand guard engaging the barrel nut, and the threads of the jam nut wherein such tensional forces prohibit rotation and removal of the hand guard relative to the jam nut.

The method for attachment of a hand guard to a firearm as recited above may include a step wherein the set screws are adjusted independently so as to manipulate the angle of a center longitudinal axis of the hand guard relative to the bore of the firearm.

DESCRIPTION OF THE PREFERRED EMBODIMENTS

Disclosed herein is a firearm hand guard rapid configuration system for the attachment and alignment of a hand guard to the receiver portion of the firearm. For examples, the firearm could be a rifle such as an AR-15, M-16, or similar tactical style rifle wherein a shooter (user) would normally grasp the trigger handle with their shooting hand and may well grasp the hand guard or forward portion of the receiver with their opposing hand in a tactical situation.

Commonly, such hand guards are attached in such a manner that the angle of the hand guard is not adjustable relative to the bore of the firearm. The bore of the firearm is the cylindrical passageway down the center of the barrel through which the bullet (projectile) will pass in its trajectory from the chamber of the firearm through the receiver, through the hand guard attachment system, and through a barrel and optional flame arrestor, silencer, or other muzzle end component(s). In addition, some prior art hand guards were simply threaded onto a barrel nut. In some applications, such hand guards were found to work themselves loose as the firearm is manipulated and fired. To counter this, such hand guards may be further fixed in place by way of screws, fasteners threaded radially through the hand guard, or alternatively fixed by way of an external jam nut. In such applications, the screws or other fasteners usually detract from the visual appeal and many be tacitly unappealing as well. As a shooter will often grasp the firearm by the hand guard, such tactile interference is detrimental. In addition, when such fasteners are threaded into the barrel nut, there is little rotational adjustability.

Figure 1:
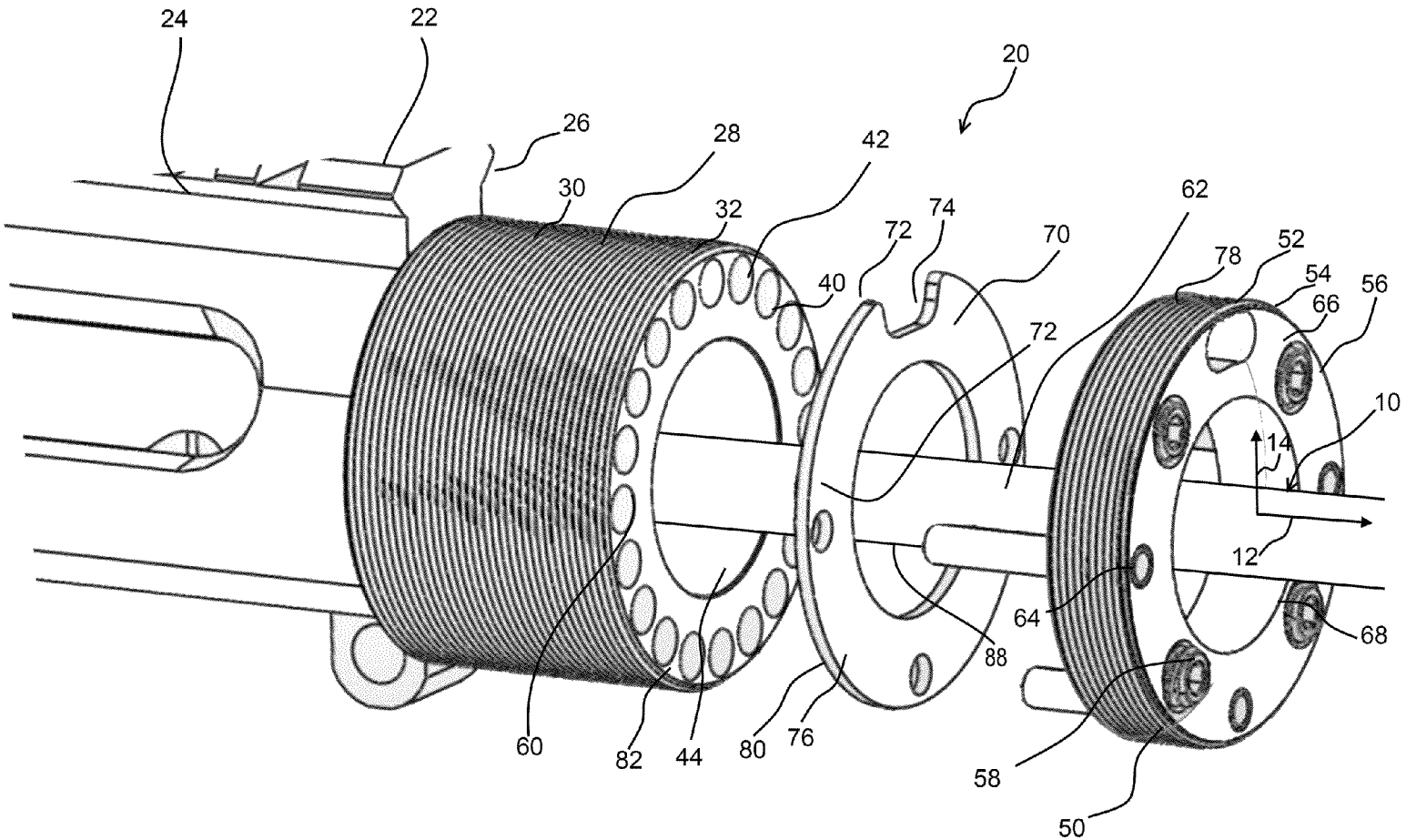
FIG. 1 is a perspective partially exploded view of several components of the disclosed apparatus.
Figure 2:
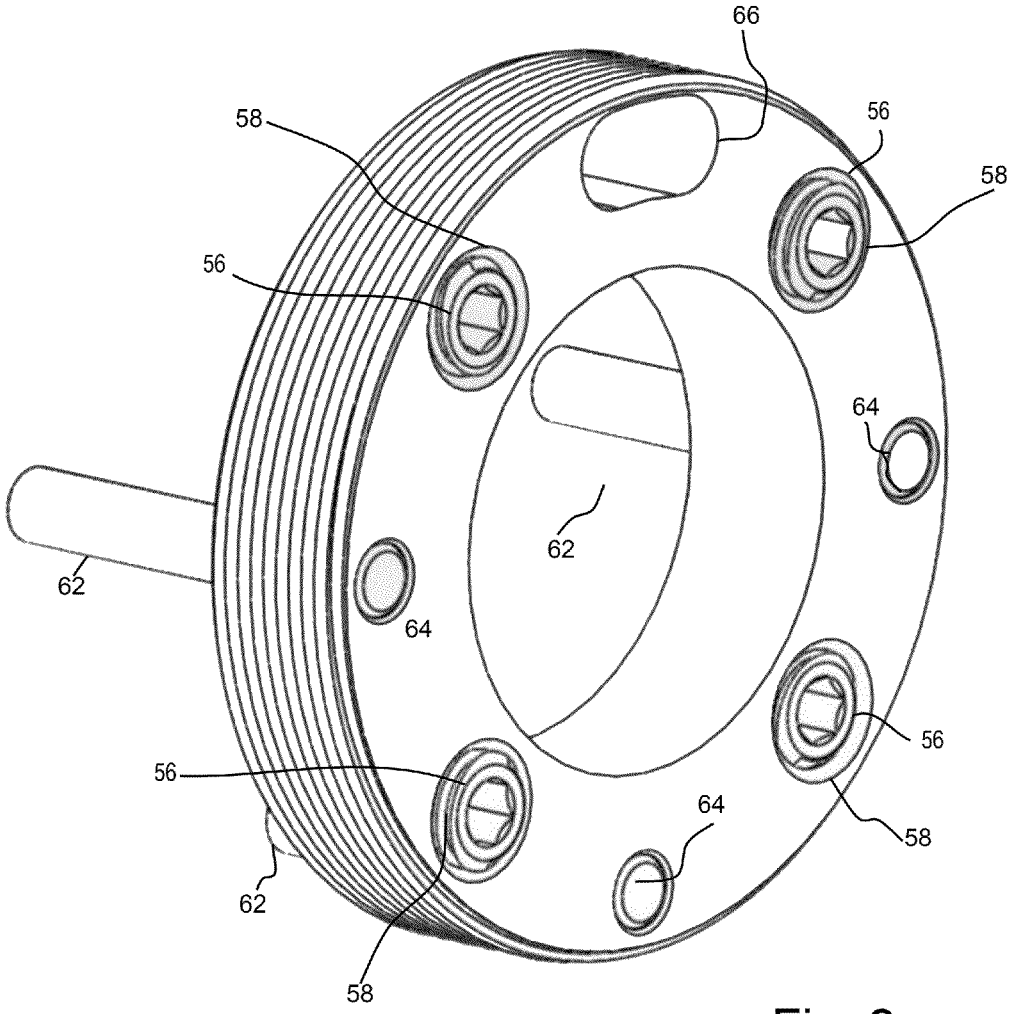
FIG. 2 is a perspective view of one component of the disclosed apparatus.
Figure 3:
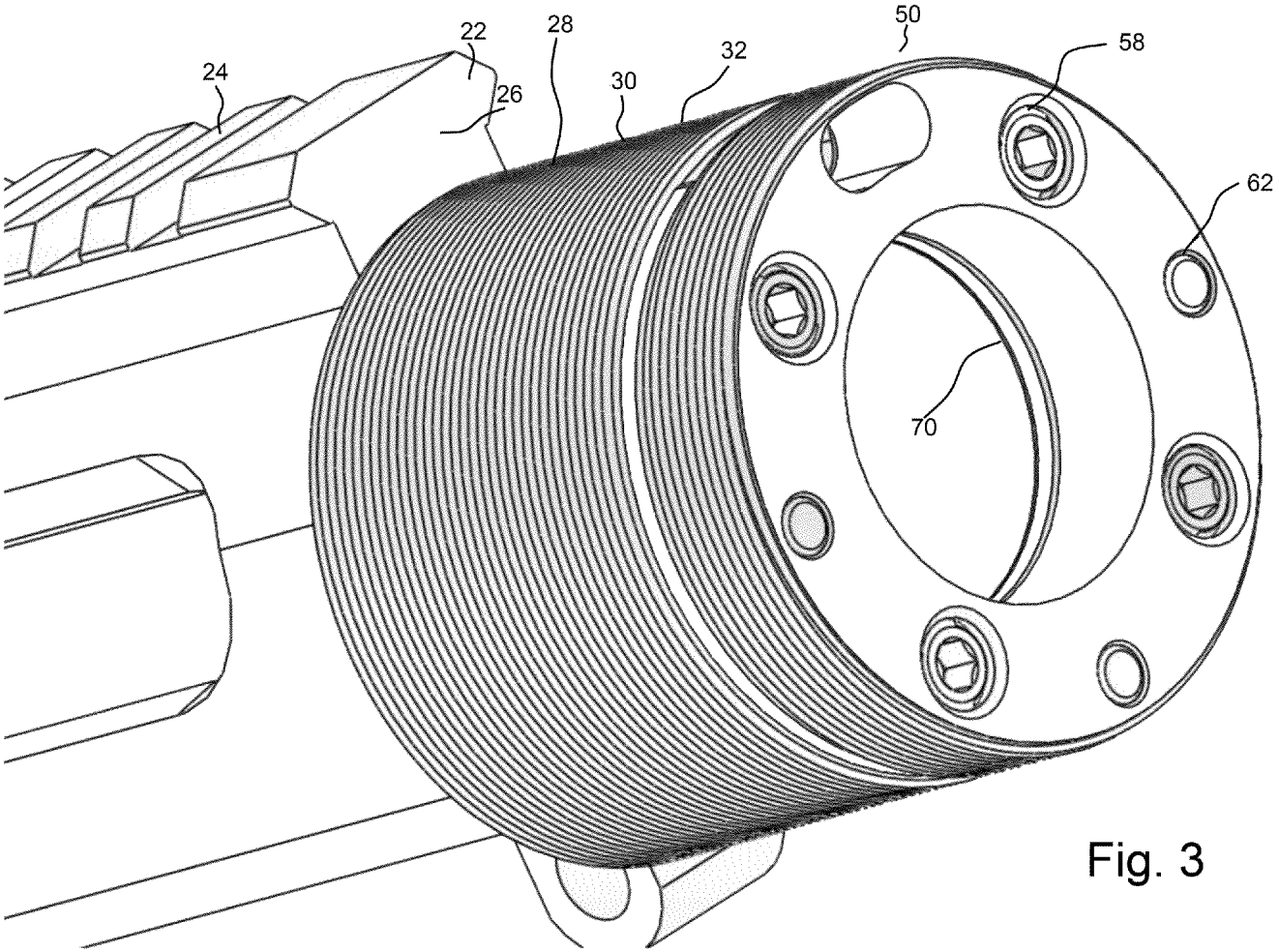
FIG. 3 is an end perspective view of the disclosed apparatus.
Figure 4:
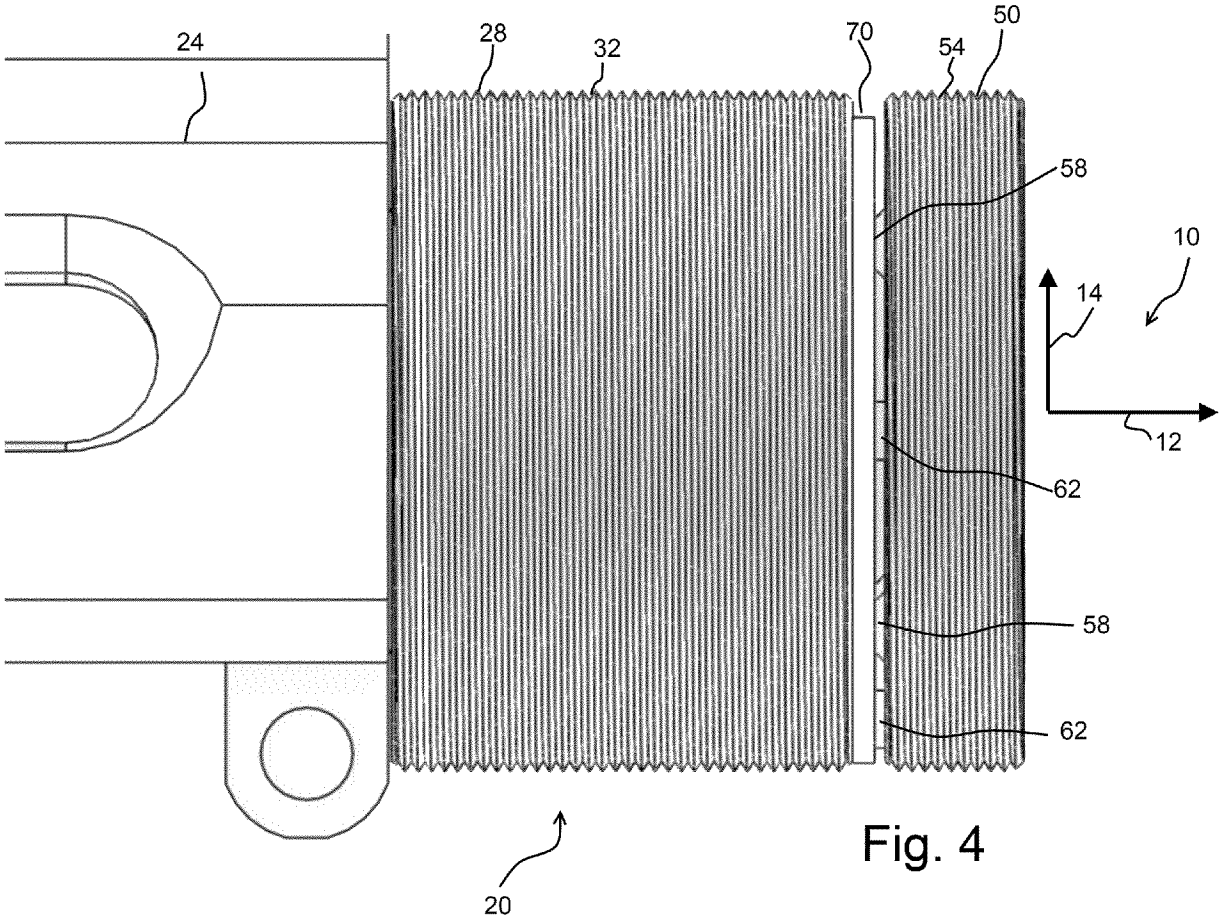
FIG. 4 is a side view of the components shown in FIG. 1.
Figure 5:
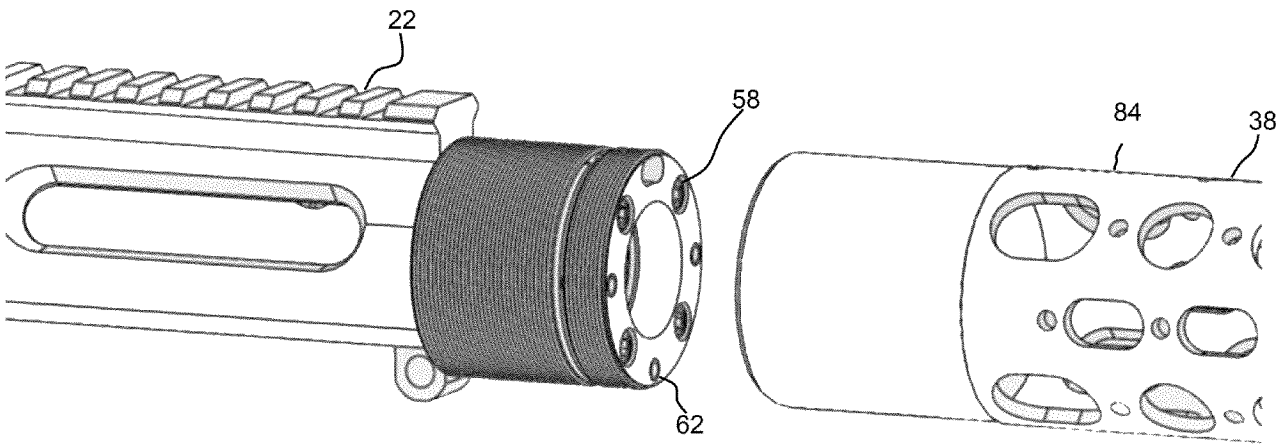
FIG. 5 is a perspective partially assembled view of the components shown in FIG. 1 with additional components added thereto

Before beginning a detailed description, and axes system 10 is shown in FIG. 1 generally comprising a longitudinal axis 12 aligned with the center bore of the firearm, and a radial axis 14 which is transfers to the longitudinal axis 12. This axes system and the orientation of the figures (drawings) in this application are intended to aid in understanding of the disclosed apparatus and are not intended to limit the application to any particular orientation. For example, firearms may be fired in an inverted orientation from that shown in the figures, or generally in any orientation.

Figure 7B:
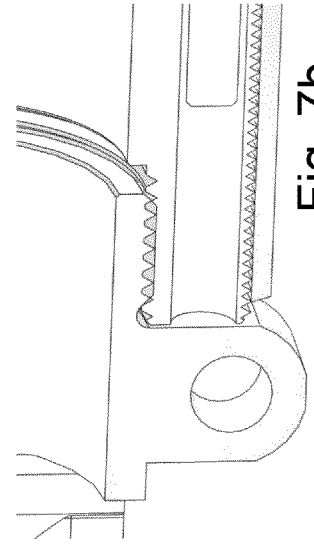
FIG. 7*b* is a detail exploded view of FIG. 7*a*.
Figure 7A:
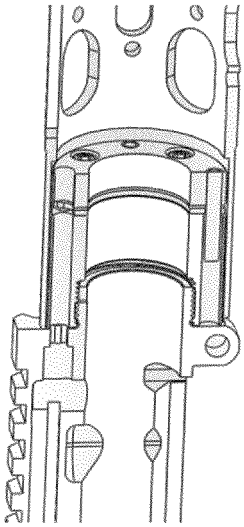
FIG. 7*a* is a side sectional view taken along the axis of the bore of the firearm.
Figure 7:
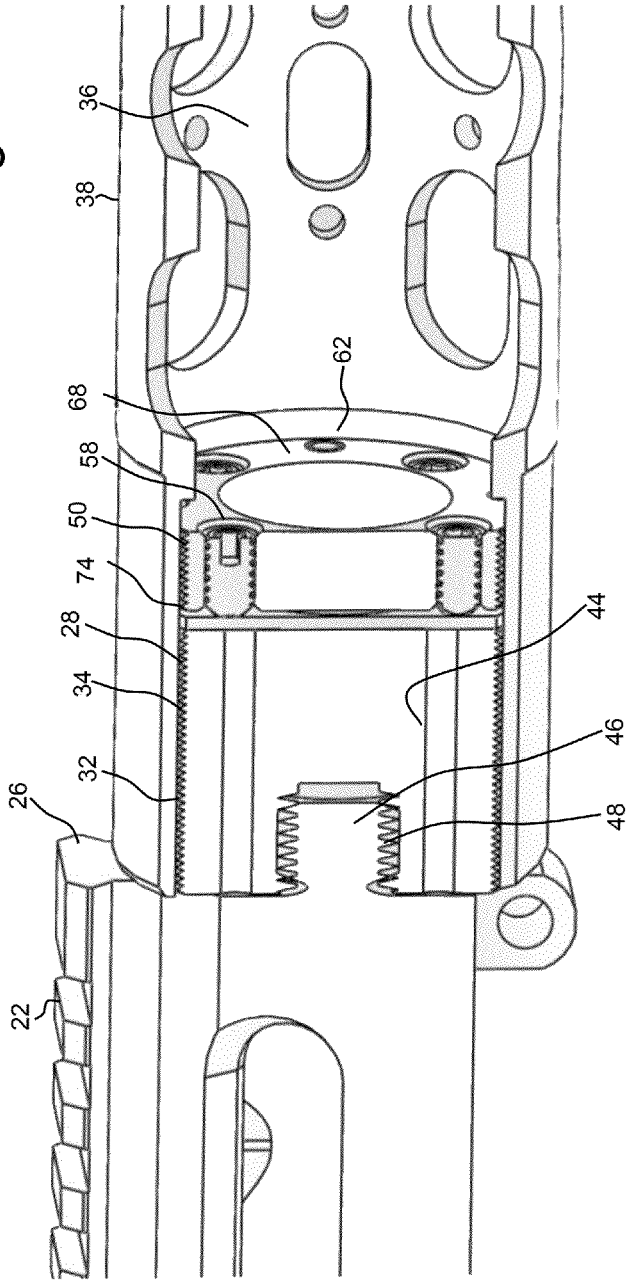
FIG. 7 is a side sectional view of the components shown in FIG. 6.

Looking to FIG. 1 an attachment system 20 is shown mounted to the receiver 22 of a firearm 24. While only a small portion of the firearm 24 is shown, (the receiver portion) such firearms are well known in the art and generally comprise no novel features relative to this disclosure. In one example, the forward end 26 of the firearm comprises a barrel nut 28 which may be mounted to the receiver 22 by welding, adhesives, fasteners, or may alternatively be formed as a (unitary) portion of the receiver 22 cast or machined therewith. In the example shown in FIG. 7, it can be seen that a portion of the male threads 48 extending from the front of the receiver 22 are cut away. A small portion of female threads 48 on the inner surface of the barrel nut 28 are also shown. The barrel nut 28 comprises a cylindrical outer surface 30 having threads 32 cut or otherwise formed there in. The male threads 32 are specifically configured to engage female threads 34 (FIG. 7) on an inner cylindrical surface 36 of the hand guard 38.

Looking back to FIG. 1, it can be seen how in this example, the barrel nut 28 comprises a number of surfaces 40 defining indexing voids 42. In addition, the barrel nut 28 in this example comprises an inner cylindrical surface 44 which is aligned (concentric) with the bore of the firearm.

A barrel extension 88 may extend through this cylindrical surface 44 to engage the forward end 26 of the receiver 22. Several different embodiments of such a barrel extension 88 are disclosed in the prior art.

FIG. 1 also shows a jam nut 50 having an outer surface 52 with male threads 54 thereupon. The threads 54 generally have the same diameter and pitch as the male threads 32 of the barrel nut 28. In this way, the female threads 34 (FIG. 7) of the hand guard 38 may be threaded onto the jam nut 50 and the barrel nut 28 in succession. This example of the jam nut 50 also comprises cylindrical threaded voids 56 through which set screws 58 may be utilized. The set screws 58 are threaded into the jam nut 50 and when correctly rotated the rearward surface of the set screws engage the forward surface 60 of the barrel nut 28 or. The operation thereof will be disclosed in more detail. In one form, one or more of the set screws may be replaced with fixed pins, where other pins are moveable (threaded). The overall design of this portion is to drive the jam nut away from the washer and/or barrel net to allow for alignment of the center axis of the hand guard to the barrel nut and firearm. In other examples, cams or balls may be utilized to the same end.

In another example, the threaded assembly utilizes a bayonet-style or Dzus-style attachment or equivalent. For example, quarter-turn fasteners are used to secure panels in equipment, airplanes, motorcycles, and racing cars that must be removed often and/or quickly. These fasteners are of an over-center design, requiring positive sustained torque in one direction to unfasten. Thus, any minor disturbance to the fastener will correct itself rather than proceed to further loosening as it would in threaded fasteners. Such fasteners are well fitted to application in firearms where firing of the device causes repeated disturbance.

In one form, the jam nut 50 further comprises a plurality of indexing pins 62 which are fixed within pin receiving surfaces 64. The indexing pins 62 may be threaded into, press fit, welded, adhered, fastened, or otherwise engaged fixedly within the pin receiving surfaces 64. When utilized, the indexing pins 62 engaged the indexing voids 42 of the barrel nut to prohibit rotation of the jam nut 50 relative to the barrel nut 28. The jam nut 50 may also comprise a surface (opening) defining a vent 66 which generally passes through the jam nut 50 for the venting of chamber exhaust gases there through. The vent 66 should align with the gas hole vent tube of the receiver 22. Such alignment is described in U.S. patent application Ser. No. 10/648,888 incorporated herein by reference. In one example, the jam nut 50 comprises an inner cylindrical surface 68 which may have the same inner diameter as the surface 44 previously described.

Also shown in FIG. 1 is a compression washer 70 having an outer surface 72 which is generally of a smaller diameter than the outer surface 30 of the barrel nut 28 and also smaller than the diameter of the outer surface 52 of the jam nut 50. This way, when the hand guard 38 is threaded onto the jam nut 50 and the barrel nut 28, the washer 70 is at least initially allowed some degree of longitudinal movement within the female threads of the hand guard 38. The washer 70 one form also comprises a plurality of surfaces defining pin receivers 72 which allow the indexing pins 62 previously described to pass there through. The washer 70 also comprises a cut away portion forming surface 74 which is generally aligned with the vent 66 of the jam nut 50 again to allow exhaust gases to pass there through. In the example shown in FIG. 1, the washer 70 comprises a forward face 76 which engages the rear surface 78 of the jam nut 50 when the set screws 58 are released. When the set screws 58 are rotated so as to travel longitudinally toward the washer 70, they will contact and press against the forward face 76 of the washer 70. The rear surface 80 of the washer 70 will then be pressed against the forward surface 82 of the barrel nut 28 and when further tensioned will result in pressure being exerted between the radially outward threads of the barrel nut 28 and the jam nut 50. Thus, when the hand guard 38 is threaded onto nuts 28/50, and the set screws 58 are tensioned, the hand guard 38 will be substantially prohibited from rotating. This will also assist in aligning of the hand guard with the axis (bore) of the firearm.

Figure 6:
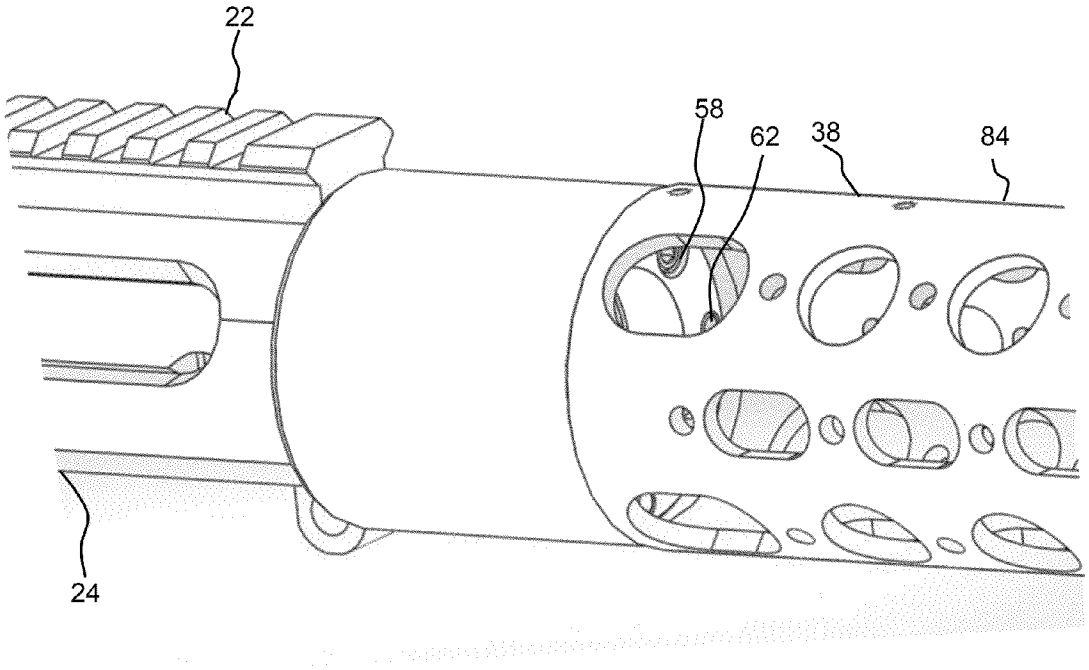
FIG. 6 is a perspective assembled view of the components shown in FIG. 1 with additional components added thereto.

This arrangement also allows the hand guard to be threaded onto the nuts 28/50 and held in place in any relative rotational position desired. The set screws 58 can be very easily seen in the sectional end view of FIG. 8 with the hand guard 38 partially cut away, it can be seen by looking to FIG. 6, that the set screws 58 are not readily visible in most external views of the apparatus. In addition, this view does not take into consideration shadows cast by the hand guard 38 and that these shadows me even more significantly hide the set screws 58 and/or pins 62 from external view.

While the alignment pins 62 and washer 70 are very beneficial in some applications, the device in other applications does not rely on these components.

While the embodiment shown utilizes a large number of indexing voids 42, the device may be formed with fewer indexing voids, as long as the number of indexing voids is at least the same as the number of indexing pins when indexing pins are used.

Figure 8:
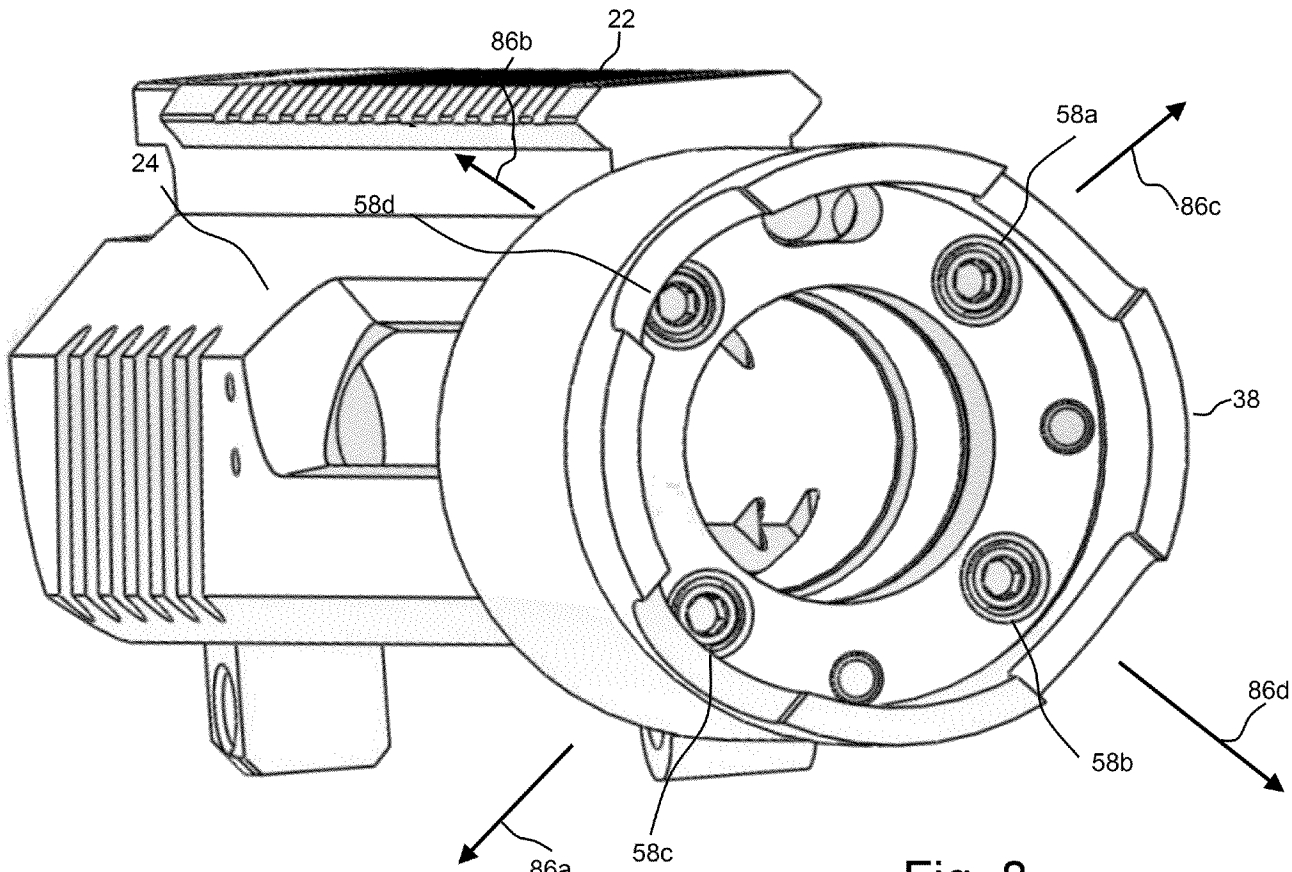
FIG. 8 is an end perspective view of the components shown in FIG. 6.
Figure 9:
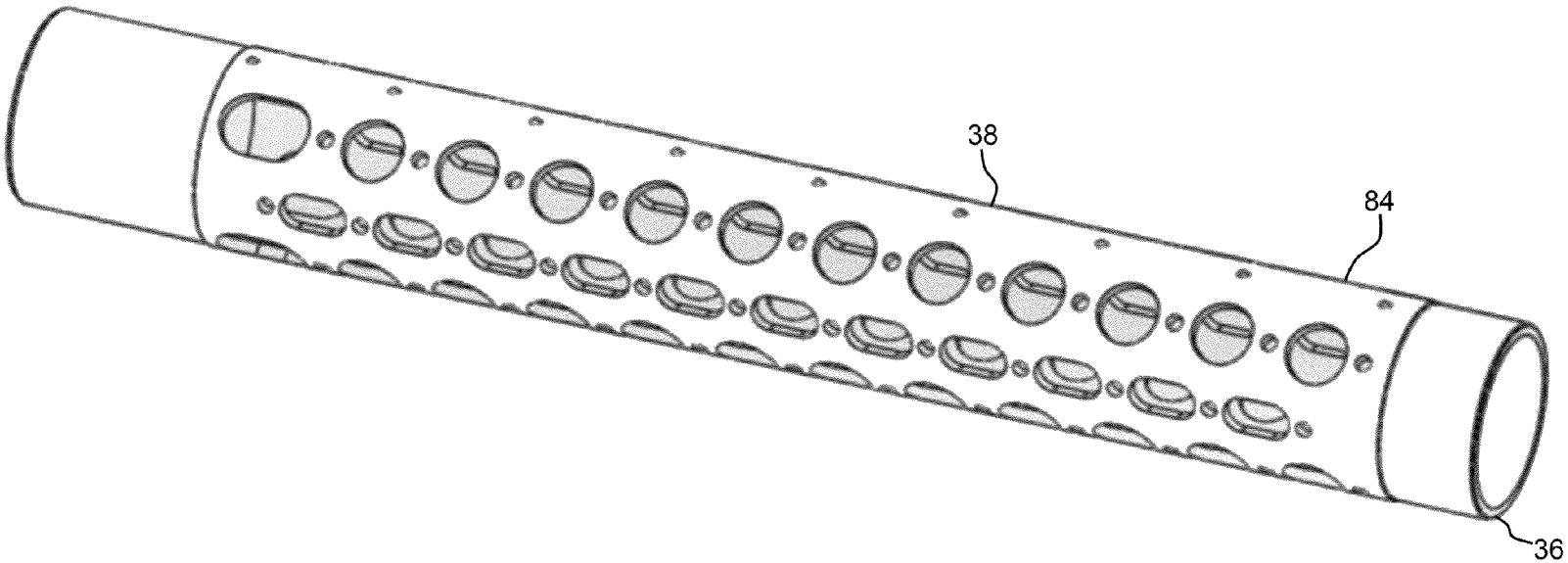
FIG. 9 is a perspective view of a hand guard component in one form.
Figure 10:
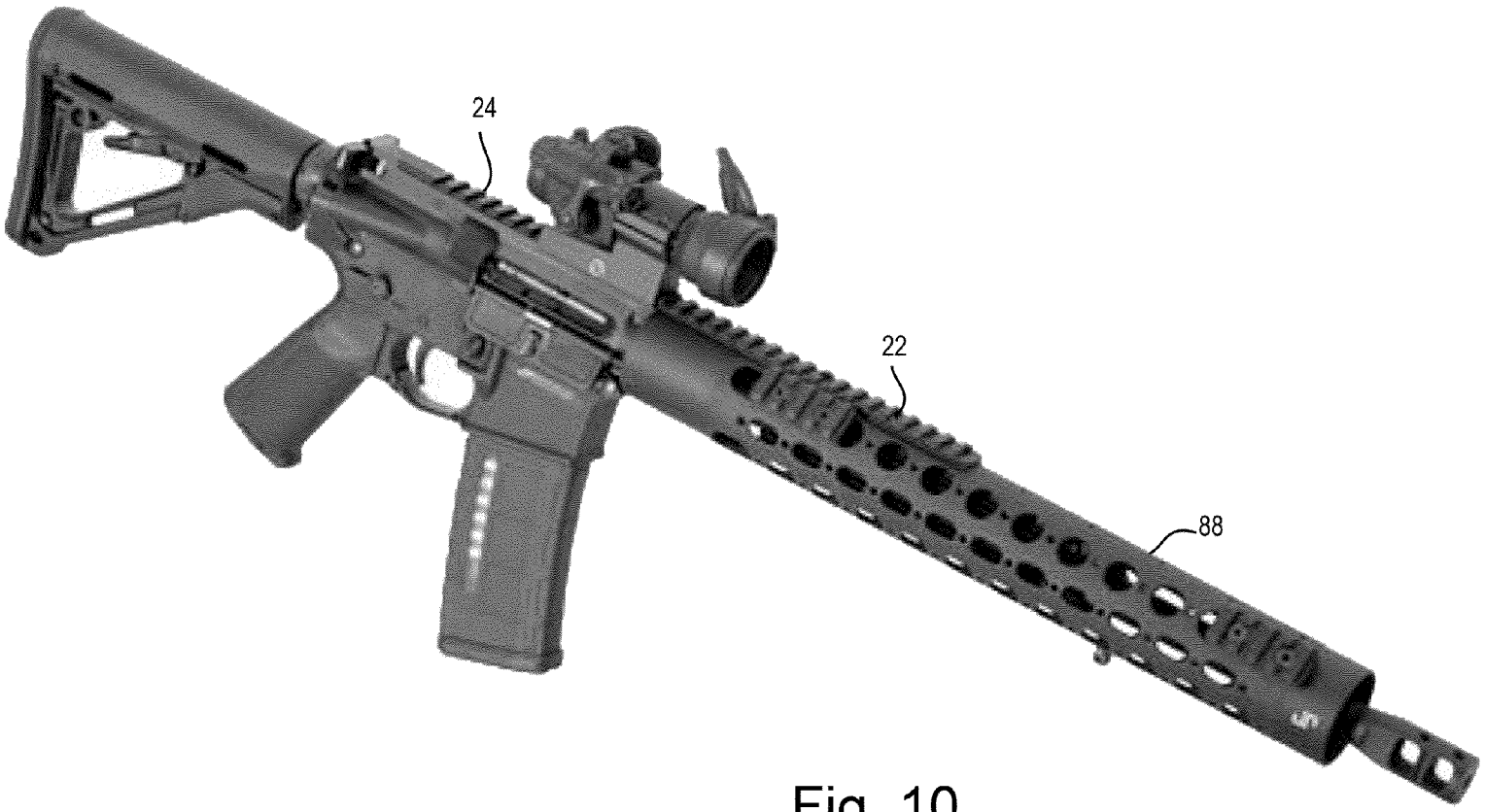
FIG. 10 is a perspective view of the disclosed apparatus in a fully assembled arrangement attached to a firearm.

In addition, looking to FIG. 8, alignment of the longitudinal axis of the hand guard 38 relative to the bore of the firearm may be selectively adjusted by selectively tensioning and releasing the set screws 58. While the set screws are generally numbered 58, an alpha-numeric system is utilized wherein each individual set screw has an alphabetic suffix to indicate a particular set screw within the general group of set screws 58. For example, looking to FIG. 8, the top right set screw is indicated as 58*a*, and going clockwise around the bore, they are numbered 58*b*, 58*c*, and 58*d* in sequence. Thus, when the set screw 58*a* is tensioned, the longitudinally outward end 84 of the hand guard 38 moves in direction of travel 86*a*. The directions of travel 86*b*-86*d* correspond to tensioning of set screws 58*b*-58*d* respectively. Alignment may be slightly different if 2, 3, 5, 7 or any other number of set screws are utilized.

While the set screws 58 shown herein utilize an Allen or Hex wrench to tension, flathead, Phillips, Torx, or other configurations may work equally as well.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept.

Therefore I claim:

1. A firearm hand guard rapid configuration system comprising:

a. a barrel nut affixed to an upper receiver of a firearm, the barrel nut in turn comprising:

i. a threaded outer cylindrical surface aligned with and co-axial to a bore of the firearm;

ii. a surface defining an inner cylindrical face aligned with and co-axial to a bore of the firearm;

iii. a plurality of surfaces defining indexing voids aligned with but not coaxial to the bore of the firearm;

iv. the indexing voids formed radially between the threaded outer surface and the inner cylindrical face of the barrel nut;

b. a jam nut comprising:

i. a threaded outer cylindrical surface aligned with and co-axial to a bore of the firearm, this surface having a thread diameter and thread pitch as the outer cylindrical surface of the barrel nut;

ii. a surface defining an inner cylindrical face aligned with and co-axial to a bore of the firearm;

iii. wherein the jam nut is longitudinally positionable relative to the barrel nut;

c. a plurality of indexing pins have an outer diameter slightly smaller than the indexing voids of the barrel nut so as to insert therein;

d. and e. a plurality of threaded set screw receivers aligned with but not coaxial to the bore of the firearm.

2. The rapid configuration system as recited in claim 1 wherein the plurality of set screws includes three or more set screws.

3. The rapid configuration system as recited in claim 1 wherein the barrel nut is threaded onto male threads extending from an upper receiver of the firearm.

4. The rapid configuration system as recited in claim 1 further comprising a plurality of indexing pins aligned with but not coaxial to the bore of the firearm.

5. The rapid configuration system as recited in claim 1 wherein the jam nut further comprises a surface defining a gas vent aligned with but not coaxial to the bore of the firearm.

6. The rapid configuration system as recited in claim 1 further comprising a radially vented hand guard having at one longitudinal end an inner cylindrical surface aligned with and co-axial to a bore of the firearm, this inner cylindrical surface having a thread diameter and thread pitch equivalent to the outer cylindrical surface of the barrel nut and jam nut.

7. A method for attachment of a hand guard to a firearm comprising the steps of:

a. providing a rapid configuration system as recited in claim 1;

b. threading the hand guard onto the jam nut and barrel nut; and c. tensioning the set screws thus imparting tensional forces between the threads of the hand guard engaging the barrel nut, and the threads of the jam nut wherein such tensional forces prohibit rotation and removal of the hand guard relative to the jam nut.

8. The method for attachment of a hand guard to a firearm as recited in claim 7 wherein the set screws are adjusted independently so as to manipulate the angle of a center longitudinal axis of the hand guard relative to the bore of the firearm.

* * * * *